US006231697B1

(12) United States Patent
Inoue et al.

(10) Patent No.: US 6,231,697 B1
(45) Date of Patent: May 15, 2001

(54) HIGH-STRENGTH AMORPHOUS ALLOY AND PROCESS FOR PREPARING THE SAME

(75) Inventors: Akihisa Inoue, 11-806, Kawauchi Jutaku, 35 banchi, Motohasekura, Kawauchi, Aoba-ku, Sendai-shi, Miyagi (JP); Tao Zhang, Sendai (JP); Hidenobu Nagahama, Sendai (JP)

(73) Assignees: Akihisa Inoue, Sendai; Ykk Corporation, Tokyo, both of (JP)

( * ) Notice: Subject to any disclaimer, the term of this patent is extended or adjusted under 35 U.S.C. 154(b) by 0 days.

(21) Appl. No.: 09/134,434

(22) Filed: Aug. 14, 1998

(30) Foreign Application Priority Data

Aug. 29, 1997 (JP) ..... 9-247522

(51) Int. Cl.[7] ..... C22F 1/18
(52) U.S. Cl. ..... 148/561; 148/672; 148/668
(58) Field of Search ..... 148/337, 403, 148/421, 424, 425, 436, 561, 668, 672; 420/422, 423, 435, 489, 492, 81

(56) References Cited

U.S. PATENT DOCUMENTS

| | | | | |
|---|---|---|---|---|
| 4,171,992 | * | 10/1979 | Tanner et al. | 148/561 |
| 4,668,424 | | 5/1987 | Sandrock . | |
| 5,735,975 | | 4/1998 | Lin et al. . | |
| 5,980,652 | * | 11/1999 | Inoue et al. | 148/403 |

FOREIGN PATENT DOCUMENTS

| | | |
|---|---|---|
| 513654 | 11/1992 | (EP) . |
| 2310430 | 8/1997 | (GB) . |
| 7-188877 | 8/1995 | (JP) . |
| 8-199318 | 8/1996 | (JP) . |

OTHER PUBLICATIONS

Inoue et al., "Effect of Additional Elements on Glass Transition Behavior and Glass Formation Tendency of Zr–AL–Cu–Ni Alloys," *Materials Transactions*, JIM, vol. 36, No. 12 (1995), pp. 1420 to 1426.

Rao, "Stoichiometry and Thermodynamics of Metallurgical Processes," 1985 Cambridge University Press, XP00208 7231, pp. 243 and 892–894.

Derwent Abstract (English Language) for Japanese Patent JP 09020968 A, Jan. 21, 1997.*

* cited by examiner

*Primary Examiner*—John Sheehan
*Assistant Examiner*—Andrew L. Oltmans
(74) *Attorney, Agent, or Firm*—Finnegan, Henderson, Farabow, Garrett & Dunner, L.L.P.

(57) ABSTRACT

A high-strength amorphous alloy represented by the general formula: $X_aM_bAl_cT_d$ (wherein X is at least one element selected between Zr and Hf; M is at least one element selected from the group consisting of Ni, Cu, Fe, Co and Mn; T is at least one element having a positive enthalpy of mixing with at least one of the above-mentioned X, M and Al; and a, b, c and d are atomic percentages, provided that $25 \leqq a \leqq 85$, $5 \leqq b \leqq 70$, $0 < c \leqq 35$ and $0 < d \leqq 15$) and having a structure comprising at least having an amorphous phase. The amorphous alloy is produced by preparing an amorphous alloy having the above-mentioned composition and containing at least an amorphous phase, and heat-treating the alloy in the temperature range from the first exothermic reaction-starting temperature ($Tx_1$: crystallization temperature) thereof to the second exothermic reaction-starting temperature ($Tx_2$) thereof to decompose the amorphous phase into a mixed phase structure consisting of an amorphous phase and a microcrystalline phase.

4 Claims, 6 Drawing Sheets

$V_f = 0\%$ $V_f = 14\%$ $V_f = 23\%$

HIGH-STRENGTH AMORPHOUS ALLOY AND PROCESS FOR PREPARING THE SAME

BACKGROUND OF THE INVENTION

1. Field of the Invention

The present invention relates to an amorphous alloy having high hardness and strength, excellent ductility, high corrosion resistance, and excellent workability, and a process for preparing the same.

2. Description of the Prior Art

Conventional Zr-based alloys having specified alloy compositions causes glass transition before crystallization, have a wide supercooled liquid region, and have a high capability of forming an amorphous phase. Since these alloys have such a high amorphizing capability, they become amorphous not only by any method wherein a high cooling rate can be secured like a liquid quenching method, but also by any ordinary casting method wherein the cooling rate is slow like a copper mold casting method, whereby tough bulk amorphous alloys can be prepared. When, however, a quenched tough thin strip formed by, for example, the liquid quenching method is heated at a temperature around the crystallization temperature thereof to precipitate crystals, the toughness thereof is deteriorated so that it can hardly be subjected to 180° contact bending. On the other hand, according to the copper mold casting method, a good amorphous bulk can be formed when cooled at a given or higher cooling rate, while the toughness thereof is deteriorated when the cooling rate is lowered to precipitate crystals.

SUMMARY OF THE INVENTION

The present invention aims at providing a high-strength amorphous alloy while solving the problem of deterioration of toughness either when a formed quenched tough thin strip or bulk material is heat-treated to precipitate crystals or when the cooling rate is lowered in the mold casting method to precipitate crystals.

The present invention provides a high-strength amorphous alloy represented by the general formula: $X_aM_bAl_cT_d$ (wherein X is at least one element selected between Zr and Hf; M is at least one element selected from the group consisting of Ni, Cu, Fe, Co and Mn; T is at least one element having a positive enthalpy of mixing with at least one of the above-mentioned X, M and Al; and a, b, c and d are atomic percentages, provided that $25 \leqq a \leqq 85$, $5 \leqq b \leqq 70$, $0 < c \leqq 35$ and $0 < d \leqq 15$) and having a structure comprising at least an amorphous phase.

The most effective element mentioned above as T is Ag. The addition of such an element T can bring about a change in the bonding of the constituent elements of the resulting amorphous alloy so as to allow it to attain a high strength without deterioration of toughness. Further, the structure of the alloy of the present invention is a mixed phase comprising an amorphous phase and a microcrystalline phase. The formation of the mixed phase structure provides excellent mechanical strength and ductility. When particular consideration is given to ductility, the amorphous phase preferably accounts for at least 50% in terms of volume fraction.

The present invention also provides a process for preparing a high-strength amorphous alloy, comprising preparing an amorphous alloy having a composition represented by the aforementioned general formula and containing at least an amorphous phase, and heat-treating the alloy in the temperature range from the first exothermic reaction-starting temperature ($Tx_1$: crystallization temperature) thereof to the second exothermic reaction-starting temperature ($Tx_2$) thereof to decompose the amorphous phase into a mixed phase structure consisting of an amorphous phase and a microcrystalline phase.

DETAILED DESCRIPTION OF THE PREFERRED EMBODIMENTS

The above-mentioned amorphous alloy can be prepared by quenching a molten alloy having the above-mentioned composition according to a liquid quenching method such as a single roller melt-spinning method, a twin roller melt-spinning method, an in-rotating-water melt-spinning method, a high-pressure gas atomizing method, or a spray method, by rapidly cooling it according to sputtering, or by slowly cooling it according to a mold casting method.

The amorphous alloy thus obtained is heat-treated. When, however, it is heat-treated below $Tx_1$, a compound useful in the present invention is hardly precipitated and any such precipitation takes a very long time unpractically. On the other hand, crystallization proceeds even in a time as short as at most 1 minute above $Tx_2$, whereby a structure having a crystalline phase homogeneously and finely dispersed in an amorphous phase can hardly be obtained.

The heating time may be 1 to 60 minutes. When it is shorter than 1 minute, no effect of the heat-treating can be expected even at a temperature close to $Tx_2$. When it exceeds 60 minutes, the crystalline phase is liable to be coarsened even at a temperature close to $Tx_1$ as described above, and is coarsened at a temperature close to $Tx_2$ while simultaneously embrittling the material unfavorably.

The amorphous alloy composition can be deformed and formed into a variety of shapes before the heat-treating by making the most of the viscous flow thereof in the supercooled region, whereby a high-strength alloy material having an arbitrary shape can be produced.

EXAMPLE 1

A mother alloy consisting of the following composition: $Zr_{65}Al_{7.5}Ni_{10}Cu_{17.5-x}Ag_x$ (wherein x=0, 5 or 10) (wherein the subscript refers to atomic %) was melted in an arc melting furnace, and then formed into a thin strip (thickness: 20 $\mu$m, width: 1.5 mm) with a single-roll liquid quenching unit (melt spinning unit) generally used. In this step, a roll made of copper and having a diameter of 200 mm was used at a number of revolutions of 4,000 rpm in an Ar atmosphere of not higher than $10^{-3}$ Torr. The case where x=5 or 10 corresponds to Example of the present invention, while the case where x=0 corresponds to Comparative Example.

The resulting thin strip of the amorphous single-phase alloy was analyzed at a heating rate of 0.67 K/s with a differential scanning calorimeter (DSC).

Figure 1:
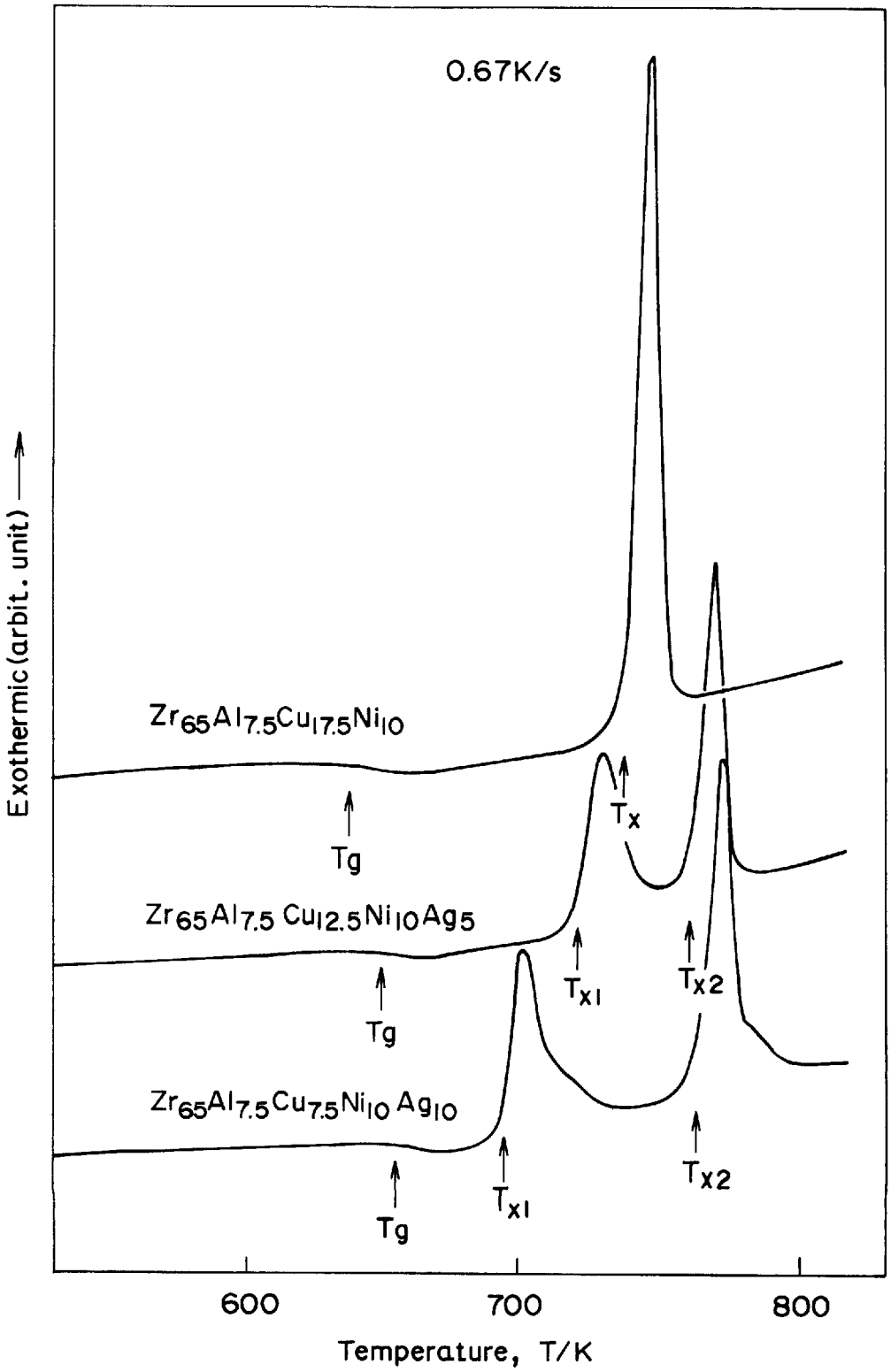
FIG. 1 is a graph showing the Tg and Tx values in Example of the present invention and Comparative Example.

The glass transition temperature (Tg) and crystallization temperature (Tx) of it were as shown in FIG. 1. The supercooled liquid region (ΔT) is a region falling between the glass transition temperature (Tg) and the crystallization temperature (Tx), while the temperature width (ΔT) of the supercooled liquid region can be found according to the formula: ΔT=Tx−Tg.

A description will now be made of the method of determining Tg and Tx in the present invention. The Tg refers to a temperature at a point of intersection of the extrapolated base line with the rising portion of the differential scanning calorimetric curve in a region of the curve where an endothermic reaction occurs, while the Tx refers to a temperature found in the same manner in a region where an exothermic reaction occurs the other way around.

It is understood from FIG. 1 that the alloys of the present invention has a narrow supercooled liquid region as compared with the alloy of Comparative Example. The ΔT is 111 K in Comparative Example, and is 63 K in Example. This makes it understandable that the addition of Ag as the element T narrows the supercooled liquid region. As is also apparent from FIG. 1, it is understood that the alloys of the present invention have two exothermic peaks. The temperature found according to the foregoing method of determining the first exothermic peak will hereinafter be referred to as $Tx_1$, and the temperature found according to the foregoing method of determining the second exothermic peak will hereinafter be referred to as $Tx_2$. Herein, Tx shown in Comparative Example corresponds to $Tx_1$.

It is understood from the DSC data that the addition of Ag elevated Tg and lowered Tx the other way around while simultaneously narrowing ΔT and instead forming two exothermic peaks, and that the region between the peaks was increasingly widened in keeping with the increasing amount of added Ag.

EXAMPLE 2

A mother alloy consisting of the following composition: $Zr_{65}Al_{7.5}Ni_{10}Cu_{17.5-x}Ag_x$ (wherein x=0, 5 or 10) (wherein the subscript refers to atomic %) was melted in an Ar atmosphere in a high-frequency melting furnace, and then cast in vacuo into a copper mold by means of the pressure of a blown gas to produce a round bar of 3, 4 or 5 mm in diameter and 50 mm in length. The temperature of the mother alloy during casting was 1,520 K, while the pressure of the blown gas was 0.02 MPa.

Figure 2:
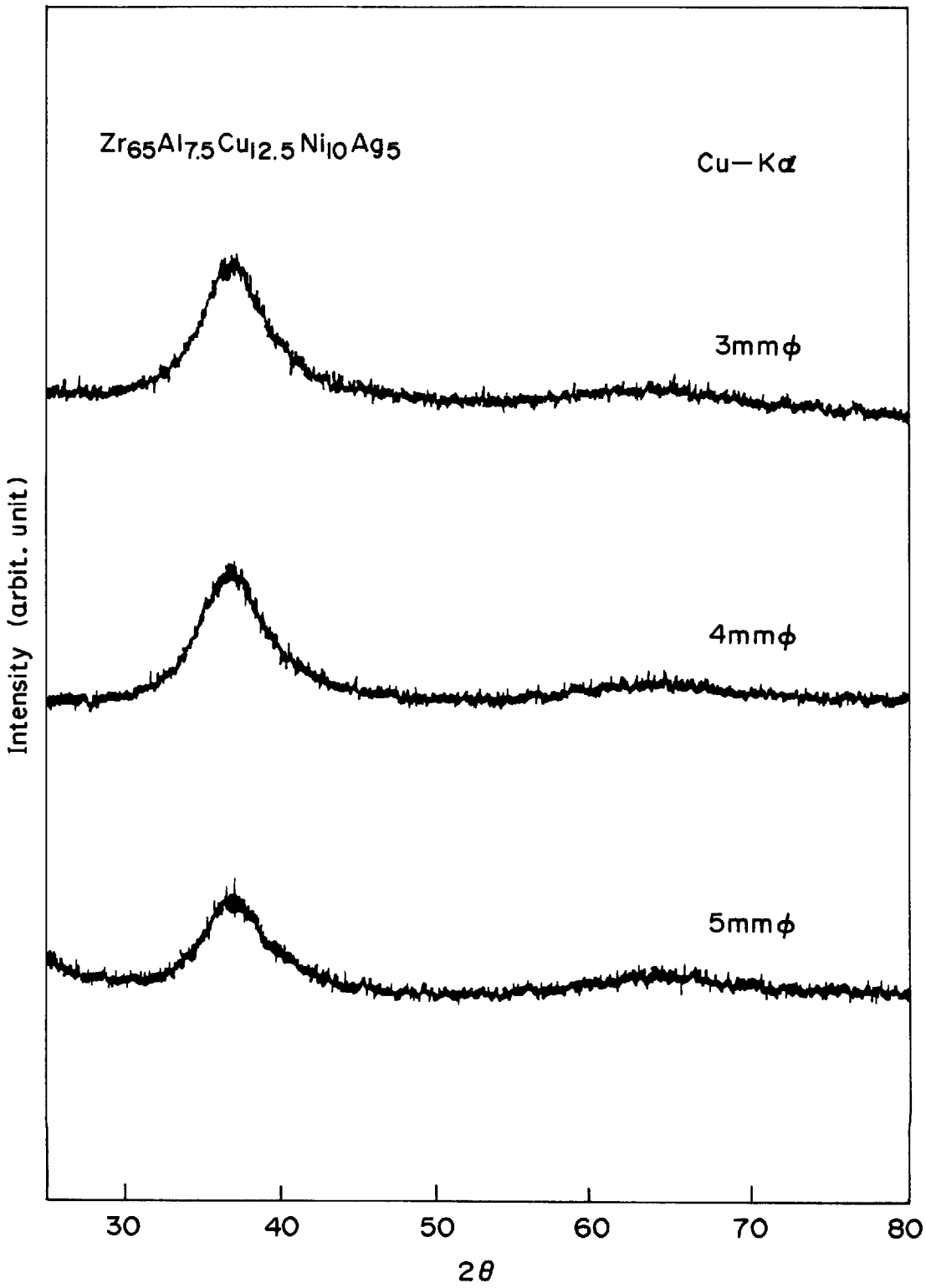
FIG. 2 is the X-ray diffraction patterns of the material of the present invention.

FIG. 2 shows the results of examination by the X-ray diffraction method of the structures of the round bars of 3, 4 and 5 mm in diameter obtained from an alloy having a composition with x being 5. Every sample showed a broad diffraction pattern peculiar to an amorphous alloy, from which it is understood that every sample was an alloy consisting of an amorphous single phase.

Figure 3:
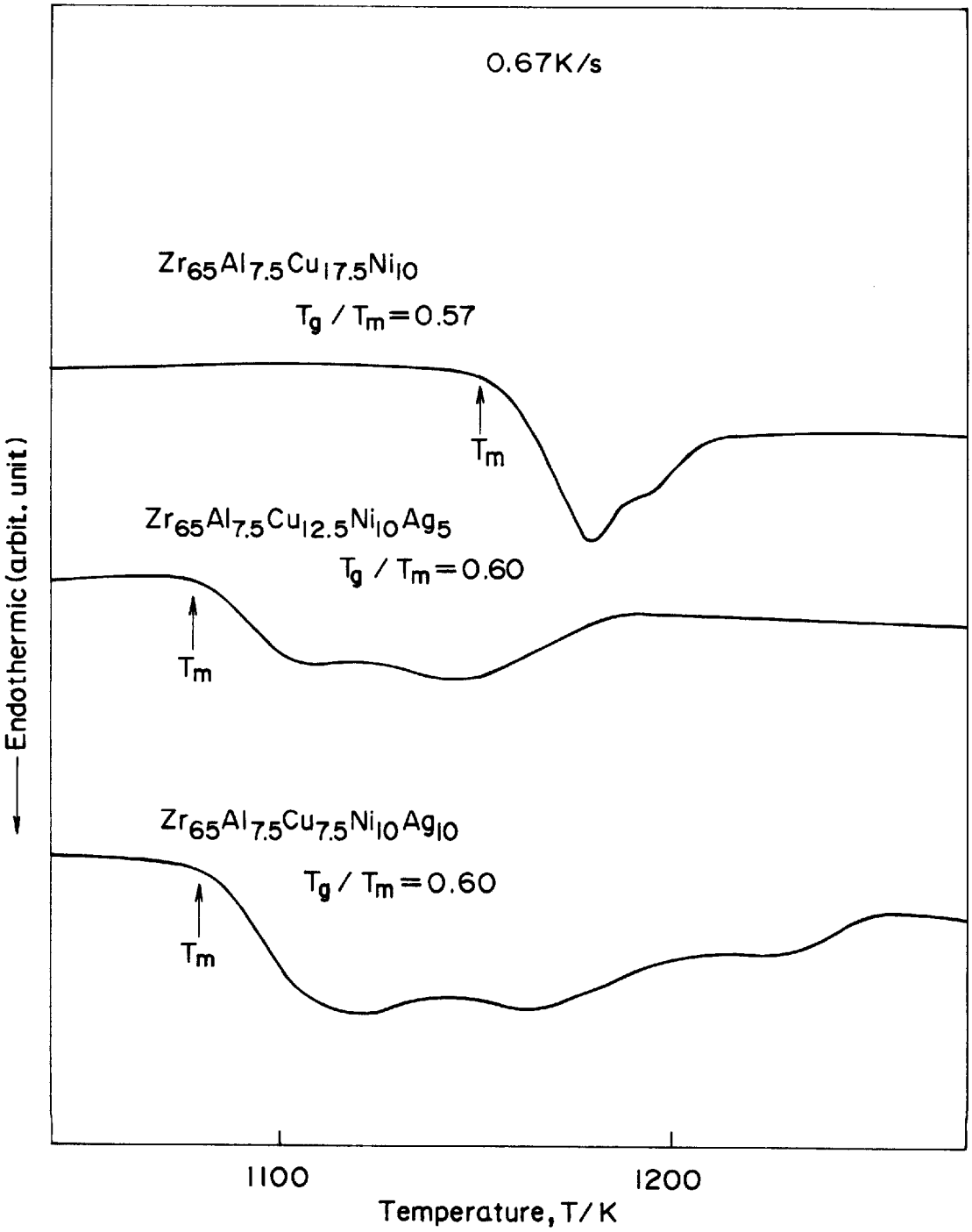
FIG. 3 is a graph showing the results of examination with a DSC in Example of the present invention and Comparative Example.

Mother alloys were examined by DTA. The examination was made around the melting points (Tm) of them. The results are shown in FIG. 3. It is understood from FIG. 3 that the alloys ($Ag_5$, $Ag_{10}$) according to the present invention were considerably low in melting point as compared with that ($Ag_0$) of Comparative Example, and that the addition of Ag thus lowered the melting point (Tm). When this result is considered together with the foregoing results of examination with the DSC as shown in FIG. 1, the Tg/Tm as a criterion for the evaluation of the capability of a material of forming glass (amorphizing capability) was increased to 0.60 in Example of the present invention as against 0.57 in Comparative Example, thus demonstrating that the addition of Ag improves the capability of forming glass (amorphizing capability).

Figure 4:
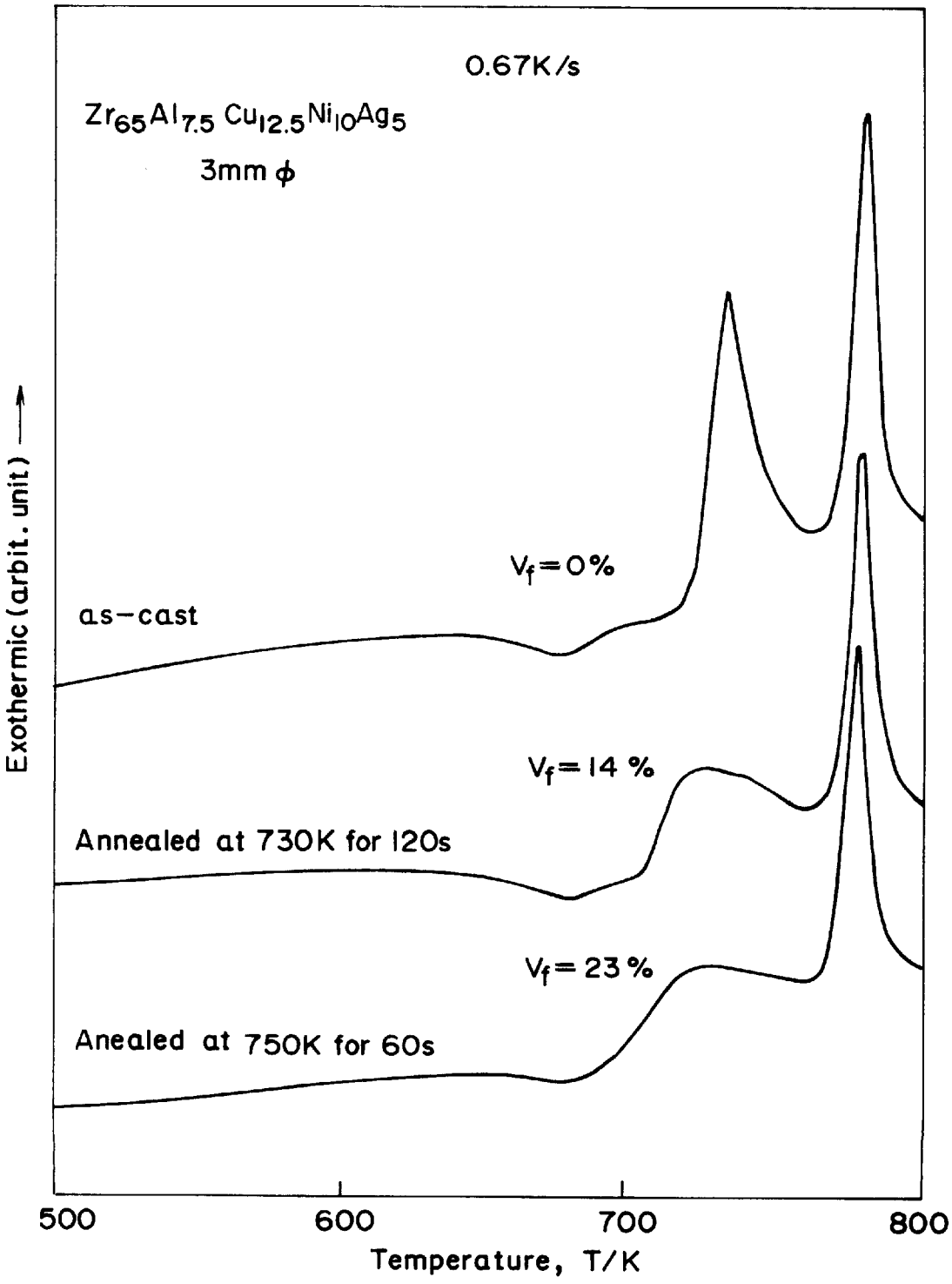
FIG. 4 is also a graph showing the results of examination of heat-treated materials with the DSC.
Figure 6:
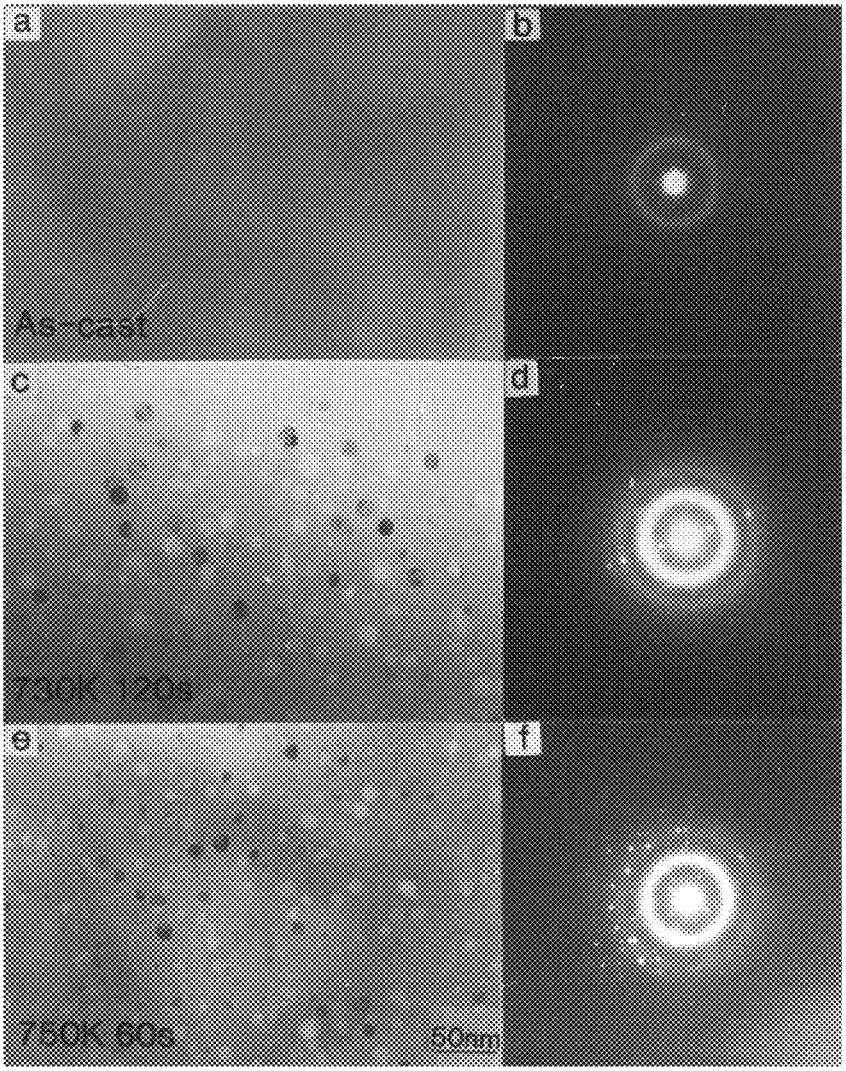
FIG. 6 is the TEM and electron diffraction photographs showing the crystalline structures in Example and Comparative Example.

The round bars of 3 mm in diameter, produced from an $Ag_5$ alloy having an amorphous single phase according to the foregoing method of Example 2, were respectively heat-treated at 730 K for 2 minutes (Sample No. 1) and for 3 minutes, and at 750 K for 1 minute (Sample No. 2) and for 2 minutes (Sample No. 3) as shown in FIG. 4. In this case, the heat-treating temperatures 730 K and 750 K are temperatures falling in the region ranging from the first exothermic reaction-starting temperature ($Tx_1$) to the second exothermic reaction-starting temperature ($Tx_2$) as is understandable from FIG. 1. The amorphous phase was decomposed into a microcrystalline phase through the heat-treating to form a mixed phase alloy consisting of an amorphous phase and the microcrytalline phase. The microstructural photograph (TEM photograph) of part of each alloy is shown in FIG. 6. The volume fraction of the crystalline phase in each alloy was as shown in Table 1.

TABLE 1

| Sample No. | Heat-treating Temp. (K.) | Heat-treating Time (min) | Volume Fraction of Crystalline Phase Vf (%) |
|---|---|---|---|
| 1 | 730 | 2 | 14 |
| 2 | 750 | 1 | 23 |
| 3 | 750 | 2 | 35 |

It is also understood that Sample No. 1 had a crystalline phase having a particle size of 20 nm and a distance between the particles of 30 nm, and that Sample No. 2 had a crystalline phase having a particle size of 15 nm and a distance between the particles of 25 nm. It is understood from the microstructural photographs as well that they were structures having precipitates (compounds) finely dispersed as a very fine crystalline phase in the amorphous phase.

Figure 5:
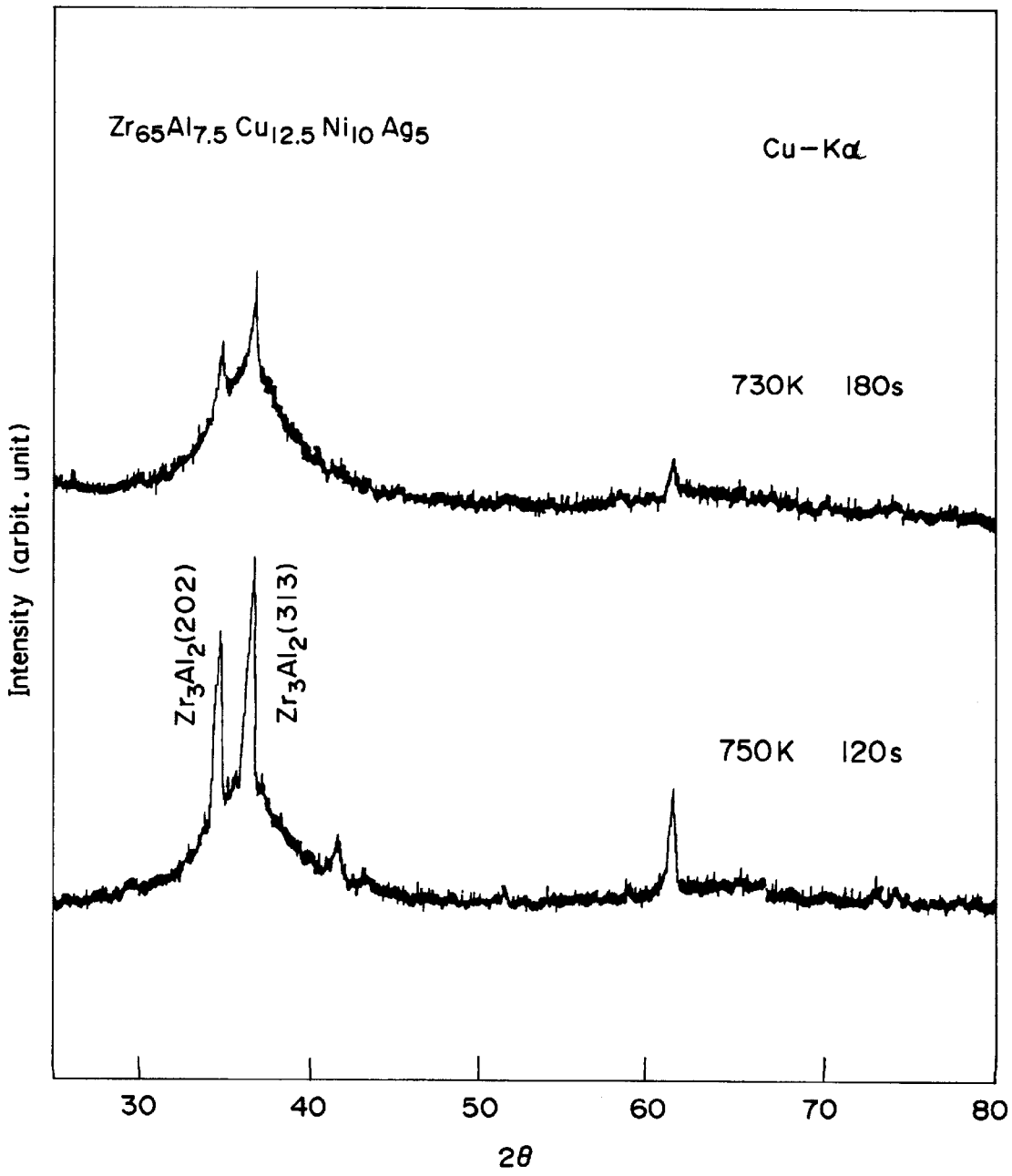
FIG. 5 shows the results of the X-ray diffraction analysis for materials heat-treated at 750K for 2 minutes and at 730 K for 3 minutes, respectively.

FIG. 5 shows the results of the X-ray diffraction analysis for Sample No. 3 heat-treated at 750K for 2 minutes and the sample heat-treated at 730 K for 3 minutes. It is understood from FIG. 5 that the compound dispersed in the amorphous phase was $Zr_3Al_2$.

Samples Nos. 1 and 2 were also examined with the DSC. It is understood from FIG. 4 that the heat-treated samples also had not only Tg and Tx with a supercooled liquid region, but also first and second exothermic peaks.

As a result of examination of the mechanical properties of Samples Nos. 1 to 3, the hardnesses of them were found to be as shown in Table 2.

TABLE 2

| Sample No. | Hardness Hv (DPN) |
|---|---|
| 1 | 465 |
| 2 | 476 |
| 3 | 480 |

Sample No. 1 and a material not heat-treated were examined with respect to tensile strength at break (of). As a result, it was found to be 1,520 MPa for Sample No. 1 and 1,150 MPa for the material not heat-treated.

It was further found out that Samples Nos. 1 to 3 were endowed with an excellent ductility, that Samples Nos. 1 and 2 in particular were capable of 180° contact bending and endowed with an especially excellent ductility, and that an especially excellent ductility was provided when the volume fraction Vf of the crystalline phase was 14 to 23%.

Although the foregoing tests were carried out using Ag selected as a representative element T, it was found out that the same results could be obtained using other element T on the basis of the fact elucidated in the present invention.

The alloy of the present invention is a material endowed not only with excellent mechanical properties and an excellent ductility, but also with an excellent corrosion resistance and an excellent workability. Further, according to the process of the present invention, a material endowed with the foregoing properties can be prepared with proper control of the structure thereof.

What is claimed is:

1. A process for preparing a high-strength alloy having a mixed phase structure consisting of an amorphous phase and a microcrystalline phase, said process comprising preparing an amorphous alloy having a composition represented by the general formula: $X_aM_bAl_cT_d$ wherein X is at least one element selected between Zr and Hf;

M is at least one element selected from the group consisting of Ni, Cu, Fe, Co and Mn;

T is at least one element having a positive enthalpy of mixing with at least one of the above-mentioned X, M and Al; and a, b, c and d are atomic percentages, provided that $25 \leqq a \leqq 85$, $5 \leqq b \leqq 70$, $0 < c \leqq 35$ and $0 < d \leqq 15$, said process comprising heat-treating said alloy in the temperature range from the first exothermic reaction starting temperature ($Tx_1$) to the second exothermic reaction starting temperature ($Tx_2$) to decompose said amorphous phase into said mixed phase structure consisting of an amorphous phase and a microcrystalline phase.

2. A process for preparing a high-strength amorphous alloy as claimed in claim 1, wherein the heat-treating is effected in said temperature range for 1 to 60 minutes.

3. A process for preparing a high-strength amorphous alloy as claimed in claim 1, wherein said alloy containing at least an amorphous phase is an alloy consisting of an amorphous single phase.

4. A process for preparing a high-strength amorphous alloy as claimed in claim 1, wherein said amorphous alloy has a supercooled liquid region in which said amorphous alloy exhibits viscous flow, wherein said viscous flow allows said amorphous alloy to be formed into desired shapes before said heat treating.

* * * * *